US009187293B2

(12) United States Patent
Schlothauer

(10) Patent No.: US 9,187,293 B2
(45) Date of Patent: Nov. 17, 2015

(54) LIFTING DEVICE, SYSTEM, AND METHOD

(71) Applicant: Timothy Craig Schlothauer, Mechanicsville, VA (US)

(72) Inventor: Timothy Craig Schlothauer, Mechanicsville, VA (US)

( * ) Notice: Subject to any disclaimer, the term of this patent is extended or adjusted under 35 U.S.C. 154(b) by 0 days.

(21) Appl. No.: 14/445,253

(22) Filed: Jul. 29, 2014

(65) Prior Publication Data

US 2015/0050116 A1 Feb. 19, 2015

Related U.S. Application Data

(60) Provisional application No. 61/911,433, filed on Dec. 3, 2013, provisional application No. 61/867,570, filed on Aug. 19, 2013.

(51) Int. Cl.
*B66C 1/12* (2006.01)
*B66C 1/16* (2006.01)

(52) U.S. Cl.
CPC ..... *B66C 1/16* (2013.01)

(58) Field of Classification Search
CPC ..... B66C 1/18; B66C 1/16; B66C 1/12; B66C 1/663; B66C 13/08; B66C 1/62; B66C 1/24; B66C 1/22; B66C 1/34
See application file for complete search history.

(56) References Cited

U.S. PATENT DOCUMENTS

| | | | | |
|---|---|---|---|---|
| 853,129 | A | 5/1907 | Simpson | |
| 1,804,423 | A | 11/1928 | Krenzke | |
| 2,690,926 | A * | 10/1954 | Betz | 294/67.21 |
| D202,814 | S | 11/1965 | Hall | |
| 3,776,349 | A | 12/1973 | Kampfer | |
| 4,473,365 | A | 9/1984 | Lappeyre | |
| 4,550,940 | A * | 11/1985 | Schweikert | 294/67.4 |
| 4,809,846 | A | 3/1989 | Hodlewsky | |
| 4,826,228 | A * | 5/1989 | Dinitz et al. | 294/81.56 |
| 4,832,187 | A | 5/1989 | Lapeyre | |
| 4,958,977 | A | 9/1990 | Snead | |
| D420,483 | S | 2/2000 | Abbestam | |
| 6,224,077 | B1 | 5/2001 | Sheng | |
| D473,032 | S | 4/2003 | Altom | |
| 6,565,136 | B1 | 5/2003 | Parker | |
| 6,662,930 | B2 | 12/2003 | Yester | |
| D505,764 | S | 5/2005 | McDaniel | |
| D528,259 | S | 9/2006 | Layne | |
| 7,448,661 | B2 | 11/2008 | Daigle | |
| D640,030 | S | 6/2011 | Fukuma | |
| 8,016,706 | B2 | 9/2011 | Junig et al. | |
| 8,038,560 | B2 | 10/2011 | Lou | |
| D655,882 | S | 3/2012 | Franzaroli | |
| 8,172,289 | B2 | 5/2012 | Mackay | |
| D672,523 | S | 12/2012 | Taylor | |
| 2005/0198937 | A1 | 9/2005 | Komiya | |

OTHER PUBLICATIONS

Apron Feeder Chain Installation, Bulk-Online Forum, 7 pages, available at http://forum.bulk-online.com/showthread.php?11940-Apron_Feeder_Chain_installation, last accessed Nov. 18, 2014.
International Search Report and Written Opinion in PCT/US14/48584, Jan. 14, 2015, 10 pages.

* cited by examiner

*Primary Examiner* — Stephen Vu
(74) *Attorney, Agent, or Firm* — Brian J. Teague

(57) ABSTRACT

A lifting device comprises three or more links hingedly joined end-to-end such that the lifting device is able to hingedly move in a first direction from a linear arrangement to a bent arrangement but is not able to hingedly move from the linear arrangement to a bent arrangement in a second direction opposite the first direction.

16 Claims, 12 Drawing Sheets

LIFTING DEVICE, SYSTEM, AND METHOD

CROSS-REFERENCE TO RELATED APPLICATIONS

This application claims priority to U.S. Provisional Application Ser. No. 61/867,570, filed Aug. 19, 2013 and U.S. Provisional Application Ser. No. 61/911,433, filed Dec. 3, 2013, the contents of which are incorporated herein by reference in their entirety.

FIELD OF THE INVENTION

The present invention relates generally to devices and methods for lifting, and more particularly to devices and methods for lifting palletized loads.

BACKGROUND

Conventional pallet movement and loading is accomplished using forklift trucks or similar forked machines. These machines must pick up and deposit pallets on flat surfaces, as even the slightest vertical obstruction can prevent its use. This limitation presents problems when a palletized load needs to be loaded onto a vehicle or trailer that has side walls, even if the side walls are relatively short.

In large scale operations (e.g., ship yards, train yards, warehouses, distribution hubs, etc.), craning and other overhead solution are available because space and lifting capacity are much greater. However, in small scale operations (e.g., big box home improvement stores, retail or wholesale building supply stores, retail or wholesale landscaping material (e.g., stone) suppliers, etc.), employees must find a way to load palletized products onto customers' vehicles or trailers without damaging the vehicle or the load.

It is known to try to overcome this limitation by the use of simple slings, straps, or ropes affixed to the pallet and to the forks of the forked machine. However, slings, straps, and ropes can damage the pallets and destabilize the loads, making the use of these items dangerous. For small quantity pallet loading (e.g., 1-3 pallets), palletized loads are often hand loaded from the pallet onto the vehicle/trailer due to the forked machines' limitations. Such hand loading subjects people to injuries to hands, feet, backs, shoulders, etc., and exposes the palletized materials to damage. It is also known that employees may ignore the limitations of the forked machines and simply try to load the pallet directly onto the receiving vehicles (e.g., customers' vehicles/trailers), thereby risking damage to the receiving vehicles.

BRIEF SUMMARY

In one embodiment of the invention, a lifting device comprises three or more links hingedly joined end-to-end such that the lifting device is able to hingedly move in a first direction from a linear arrangement to a bent arrangement but is not able to hingedly move from the linear arrangement to a bent arrangement in a second direction opposite the first direction.

The three or more links may comprise a first link, a second link, and a third link. Each link may comprise a first end and a second end such that the first end of the second link is hingedly joined to the second end of the first link and such that the second end of the second link is hingedly joined to the first end of the third link. The first link may comprise a single finger projecting from its second end. The second link may comprise two fingers projecting from its first end. Through-holes may be defined in each of the single finger of the first link and the double fingers of the second link. The first link and the second link may be aligned such that the through-holes of the single finger and the double fingers may be aligned. A hinge pin may be at least partially inserted through each of the through-holes of the single finger and the double fingers. The second end of the first link may comprise a first shoulder on one side of the single finger and a second shoulder on an opposite side of the single finger. The first end of the second link may comprise a shoulder between the double fingers. A contour of a distal end of the single finger may cooperate with a contour of the shoulder between the double fingers and a contour of a distal end of each of the double fingers may cooperate with a contour of a corresponding one of the first and second shoulders on opposite sides of the first finger such that the lifting device is able to hingedly move in the first direction from the linear arrangement to a bent arrangement but is not able to hingedly move from the linear arrangement to a bent arrangement in the second direction opposite the first direction.

The second link may comprise a single finger projecting from its second end. The third link may comprise two fingers projecting from its first end. Through-holes may be defined in each of the single finger of the second link and the double fingers of the third link. The second link and the third link may be aligned such that the through-holes of the single finger of the second link and the double fingers of the third link may be aligned. A hinge pin may be at least partially inserted through each of the through-holes of the single finger of the second link and the double fingers of the third link.

The first link may comprise at least one finger projecting from its second end. The second link may comprise at least one finger projecting from its first end. Through-holes may be defined in each of the at least one finger of the first link and the at least one finger of the second link. The first link and the second link may be aligned such that the through-holes of the at least one finger of the first link and the at least one finger of the second link may be aligned. A hinge pin may be at least partially inserted through each of the through-hole of the at least one finger of the first link and the through-hole of the at least one finger of the second link. A contour of a distal end of the at least one finger of the first link may cooperate with a contour of a shoulder adjacent the at least one finger of the second link and a contour of a distal end of the at least one finger of the second link may cooperate with a contour of a shoulder adjacent the at least one finger of the first link such that the lifting device is able to hingedly move in the first direction from the linear arrangement to a bent arrangement but is not able to hingedly move from the linear arrangement to a bent arrangement in the second direction opposite the first direction.

The second link may comprise at least one finger projecting from its second end. The third link may comprise at least one finger projecting from its first end. Through-holes may be defined in each of the at least one finger of the second end of the second link and the at least one finger of the first end of the third link. The first link and the second link may be aligned such that the through-holes of the at least one finger of the second end of the second link and the at least one finger of the first end of the third link may be aligned. A hinge pin may be at least partially inserted through each of the through-hole of the at least one finger of the second end of the second link and the at least one finger of the first end of the third link.

The device may further comprise a flexible sleeve at least partially enclosing the three or more links, the flexible sleeve having a first end and a second end. The flexible sleeve may fully enclose the three or more links. The flexible sleeve may be constructed of fabric. The fabric may comprise nylon. One or more of the links may be affixed to an inside surface of the flexible sleeve.

The device may further comprise a first strap having a first end and a second end, the second end being affixed to or protruding from the first end of the flexible sleeve, and a second strap having a first end and a second end, the second end being affixed to or protruding from the second end of the flexible sleeve. The first strap may comprise a loop at its first end and the second strap may comprise a loop at its first end.

The device may further comprise a connecting strap affixed to or contiguous with the second end of the first strap and the second end of the second strap. The connecting strap may be at least partially enclosed within the sleeve. The connecting strap may be fully enclosed within the sleeve. The first strap, the second strap, and the connecting strap may together comprise a unitary structure. The connecting strap may be at least partially affixed to an inside surface of the flexible sleeve.

In alternative embodiments of the invention, a method of lifting comprises (a) inserting a first end of a lifting device underneath an object to be lifted until the first end of the lifting device protrudes from under a first side of the object and a second end of the lifting device protrudes from under a second, opposite side of the object and such that the lifting device is in a first orientation, (b) rotating the lifting device 180 degrees about a longitudinal axis such that the lifting device is in a second orientation, and (c) applying a lifting force to the first and second ends of the lifting device.

The lifting device may be a first lifting device, and the method may further comprise (d) inserting a first end of a second lifting device underneath the object to be lifted until the first end of the second lifting device protrudes from under the first side of the object and a second end of the first lifting device protrudes from under an opposite side of the object and such that the second lifting device is in a first orientation, (e) rotating the second lifting device 180 degrees about a longitudinal axis such that the second lifting device is in a second orientation, (f) and applying a lifting force to the first and second ends of the second lifting device concurrently with applying the lifting force to the first and second ends of the first lifting device.

In alternative embodiments of the invention, a lifting device comprises three or more links hingedly joined end-to-end such that each link is able to hingedly move in a first direction from a linear arrangement to a bent arrangement but not able to hingedly move from the linear arrangement in a second direction opposite the first direction. Other features of this alternative embodiment are the same as or similar to the features of the first embodiment described in this section.

BRIEF DESCRIPTION OF THE SEVERAL VIEWS OF THE DRAWING(S)

Reference is made herein to the accompanying drawings, which are not necessarily drawn to scale, and wherein.

DETAILED DESCRIPTION

Figure 1:
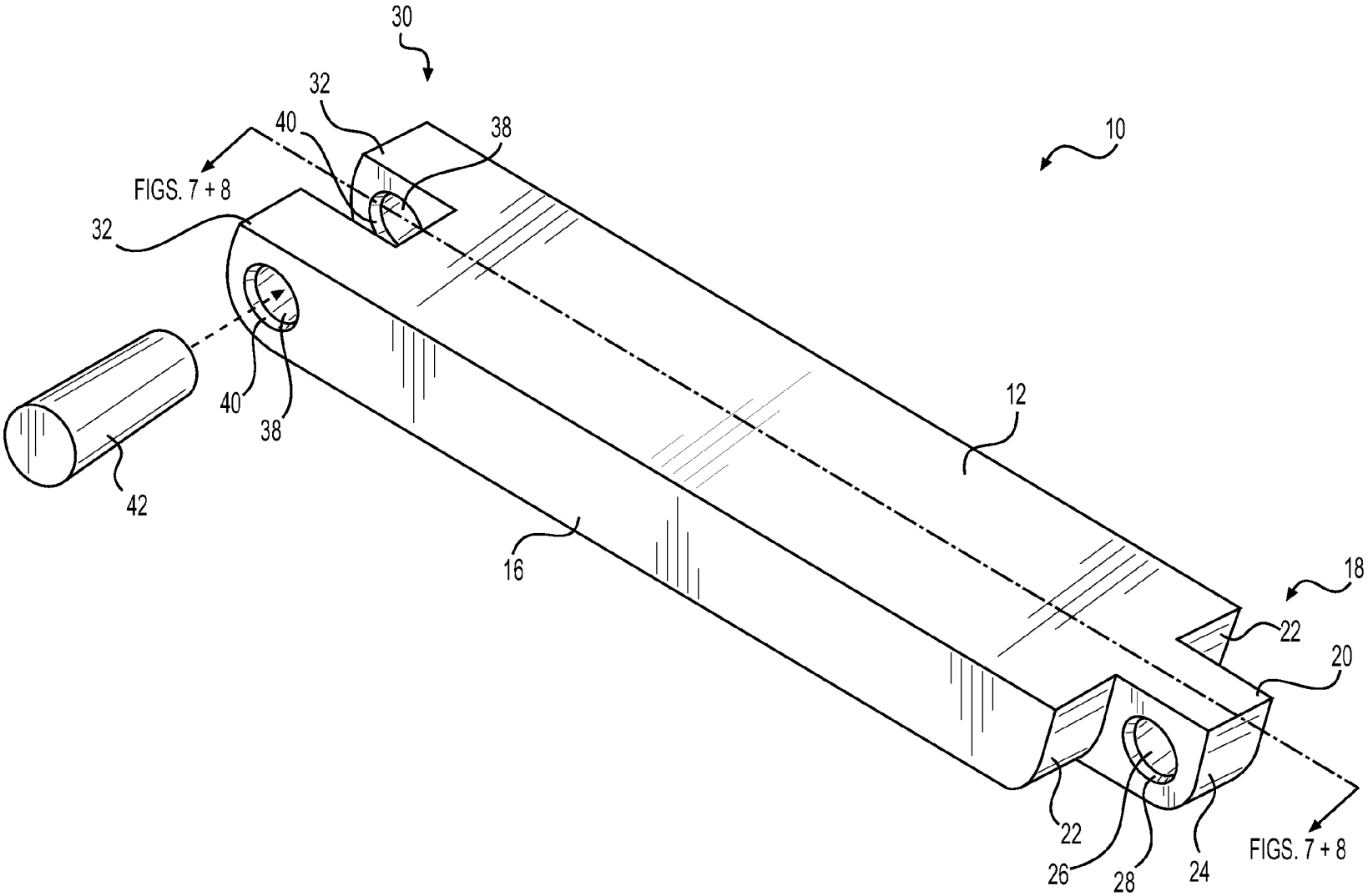
FIG. 1 is a perspective view of one link of a lifting device, in accordance with embodiments of the invention.

Certain terminology is used in the following description for convenience only and is not limiting. The words "right," "left," "lower," "bottom," "upper," and "top" designate directions in the drawings to which reference is made. The words "leftward," "rightward," "inward," "outward," "up," "upward," "down," and "downward" refer to directions toward and away from, respectively, the geometric center of the device, and designated parts thereof, in accordance with the present disclosure. Unless specifically set forth herein, the terms "a," "an" and "the" are not limited to one element, but instead should be read as meaning "at least one." The terminology includes the words noted above, derivatives thereof and words of similar import.

Embodiments of the invention comprise devices and methods for lifting a load, such as a load on a pallet. Embodiments of the invention will be described herein in reference to lifting pallets, but embodiments of the invention are not limited to lifting pallets but rather may be used to lift any suitable items or loads. Embodiments of the invention allow a user to easily and safely lift and load pallets onto vehicles and trailers that have vertical sides, or over other vertical obstructions. The lifting device of embodiments of the invention may be used in conjunction with conventional forklift trucks or other forked machines. The lifting device of embodiments of the invention uses a uni-directional link system that is capable of lifting very heavy loads in a stable manner while greatly reducing the likelihood of damage to pallets and receiving vehicles.

Figure 9:
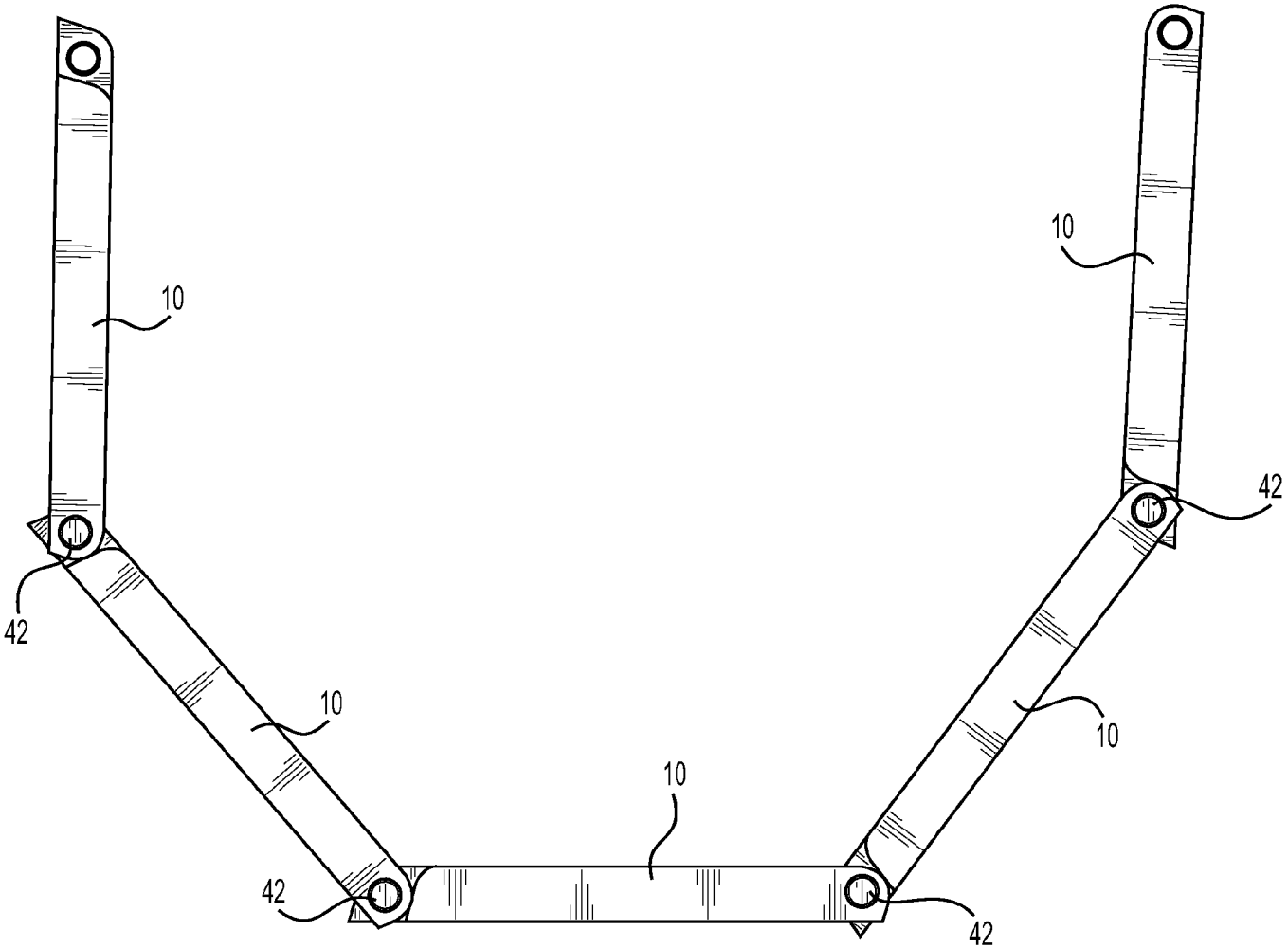
FIG. 9 is a side view of multiple links (like the link of FIG. 1) hingedly affixed to each other to form a portion of the lifting device and in a flexed or bent arrangement, in accordance with embodiments of the invention.
Figure 10:
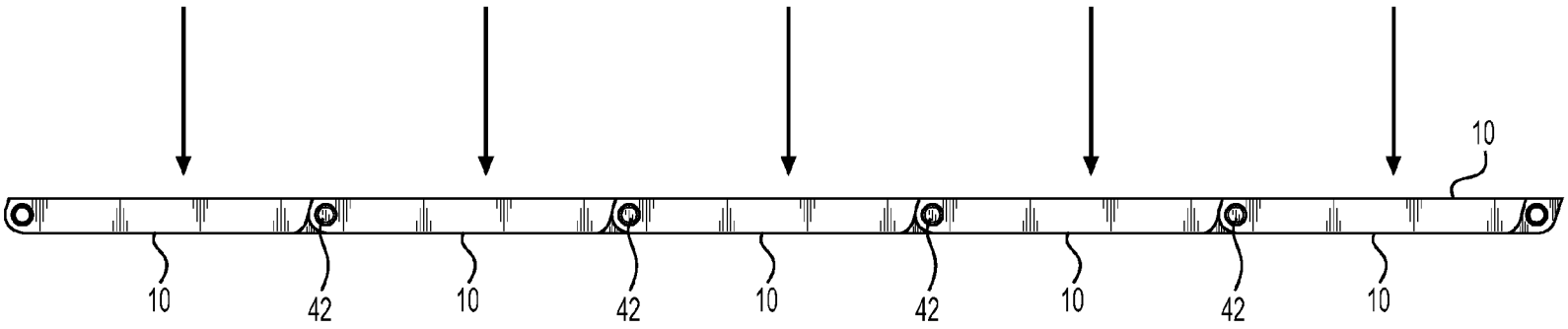
FIG. 10 is a side view of the multiple links of FIG. 9 in a straight arrangement and rotated 180 degrees about a longitudinal axis.

The lifting device of embodiments of the invention comprises three or more links hingedly joined end-to-end (five links are used in the illustrated embodiments, although any suitable number of links may be used). The structure of the links, when hinged together, provides a uni-directional lifting system. The hinged-together links are able to hingedly move in a first direction from a linear arrangement to a bent arrangement (such as illustrated in FIG. 9) but are not able to hingedly move from the linear arrangement to a bent arrangement in a second direction opposite the first direction. Thus, when force is applied to one side of the hinged-together links, the links bend. However, when a load or other force is applied to the opposite side of the hinged-together links, the links do not bend but rather maintain a linear arrangement (as illustrated in FIG. 10) that is capable of supporting a load (such a supported load is indicated by the downward arrows in FIG. 10). As will be explained further in relation to FIGS. 12 and 13, this enables the lifting device of embodiments of the invention to be bent for easy insertion into the fork pockets between the top and bottom decks of a pallet and then rotated 180 degrees to enable the lifting device to lift the pallet.

Figure 13:
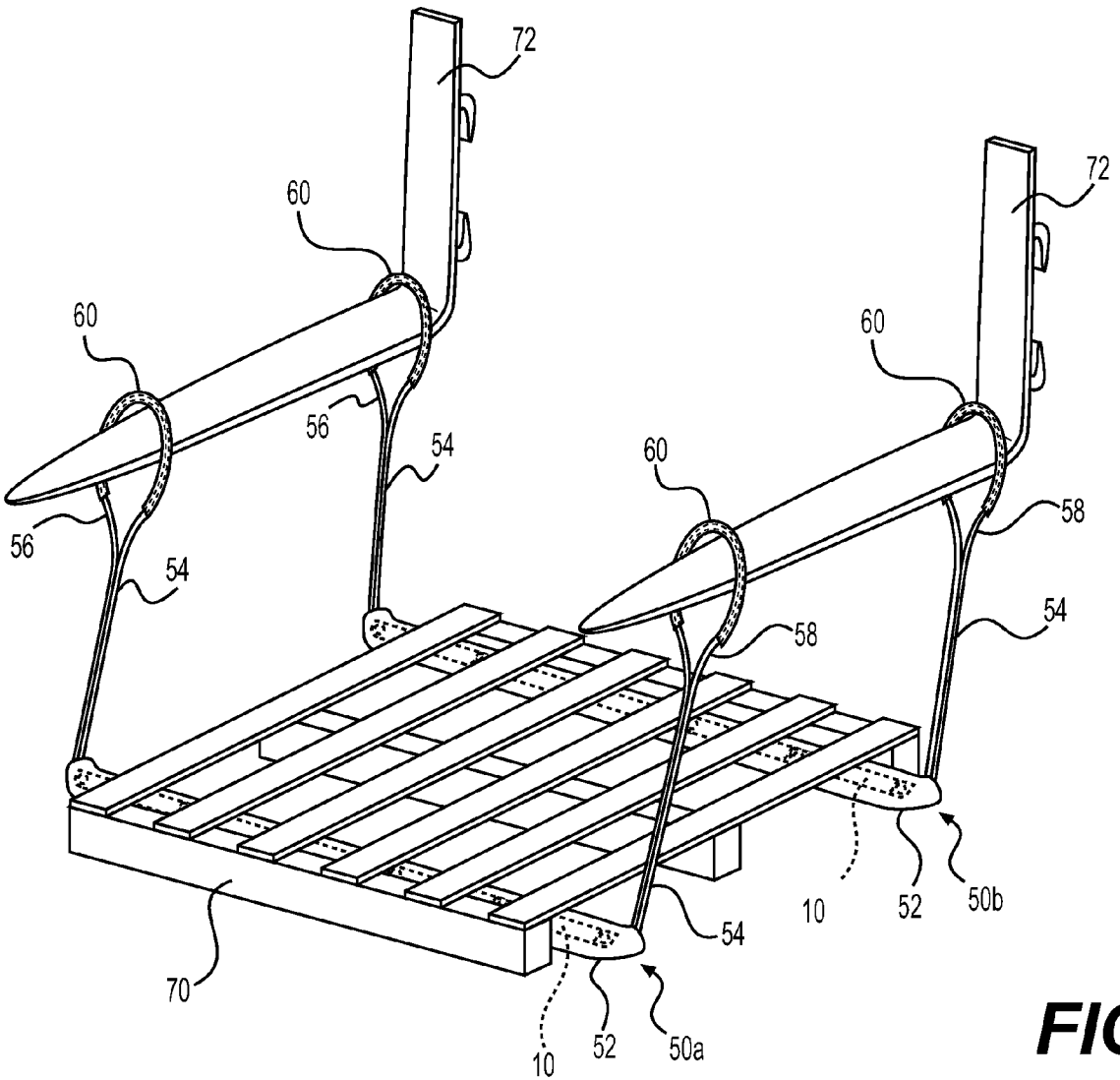
FIG. 13 is a perspective view of the two lifting devices of FIG. 12 being used to lift the pallet using a forked machine.

Referring now to FIGS. 1-8, multiple views of one link 10 of a lifting device are shown, in accordance with embodiments of the invention. Link 10 may be constructed out of any suitably rigid and strong material, including but not limited to aluminum (or alloys thereof), steel, rigid plastic, or the like. In one embodiment of the invention, link 10 is constructed out of 6061-T6 aluminum alloy. Link 10 may be constructed in any suitable size (length, width, thickness) to provide the desired strength and load bearing/lifting ability. Generally, the number of links and the length of each link are selected such that the ends of the hinged-together links extend past the ends of a pallet when the device is inserted into a pallet (as seen in FIG. 13). The number of links is selected to provide a desired amount of bendability (generally, the more links in the device the more bendable the device is) without needlessly increasing the cost and complexity of the device (generally, the more links in the device the more expensive and time-consuming it is to manufacture and assemble the device). In one embodiment of the invention, each link is 7.614 inches long overall (and 6.75 inches from the center of the through hole on one end to the center of the through holes on the opposite end), 1.5 inches wide, and 0.75 inches thick. In another embodiment of the invention, each link is 10.374 inches long overall (and 9.5 inches from the center of the through hole on one end to the center of the through holes on the opposite end), 2 inches wide, and 1.5 inches thick.

As seen in FIGS. 1-8, link 10 is generally elongated, having a first end 18 and a second end 30. The width of the top surface 12 and bottom surface 14 is typically (although not necessarily) greater than the height of the side surface 16 (the opposite side is not illustrated but is a mirror image of side surface 16). When link 10 is hingedly joined with other (typically identical) links (for purposes of this description, link 10 may be referred to as the second link in the lifting device), the first end 18 of link 10 is hingedly joined to the second end of an adjoining link (which may be referred to as the third link in the lifting device) and the second end 30 of link 10 is hingedly joined to the first end of another adjoining link (which may be referred to as the first link in the lifting device). Link 10 comprises a single finger 20 projecting from its first end 18 and double fingers 32 projecting from its second end 30. A through-hole 26 is defined in the single finger 20 and through-holes 38 (which are aligned with each other) are defined in each of the double fingers 32. The adjoining links (first and third) will typically also each comprise a single finger with a through-hole at their first ends and double fingers with corresponding through-holes at their second ends. (In alternative embodiments of the invention, the fingers on the outer ends of the two outermost links may be omitted, as these fingers are not needed to join with other links. However, it is typically more cost effective to have all the links be identical in order to avoid needing to manufacture and stock additional stock keeping units (SKUs).)

To hingedly join link 10 with the adjoining first and third links, the single finger 20 of link 10 is inserted between the double fingers of the adjoining third link such that the through-holes of the three fingers are aligned. A hinge pin 42 is then inserted (such as by press fitting) through all three of the aligned through-holes. Similarly, the single finger of the adjoining first link is inserted between the double fingers 32 of link 10 such that the through-holes of the three fingers are aligned. A hinge pin 42 is then inserted (such as by press fitting) through all three of the aligned through-holes. (While only one hinge pin 42 is illustrated in FIG. 1, it should be appreciated that each link (except the two outermost links) will be hingedly joined to adjoining links using a hinge pin on each end.) Hinge pin 42, which in one embodiment of the invention is constructed of 26,000 lb. shear steel, is pressed into place. Hinge pin 42 may be generally cylindrical, or may have a slightly sloped wall (such that the hinge pin is a truncated cone). The inner walls of the through-holes 26, 38 will generally correspond to the shape of the hinge pin. The through-holes 26, 38 may have sloped, funnel-shaped openings 28, 40 (respectively) to enable easier insertion of the hinge pin 42.

Figure 2:
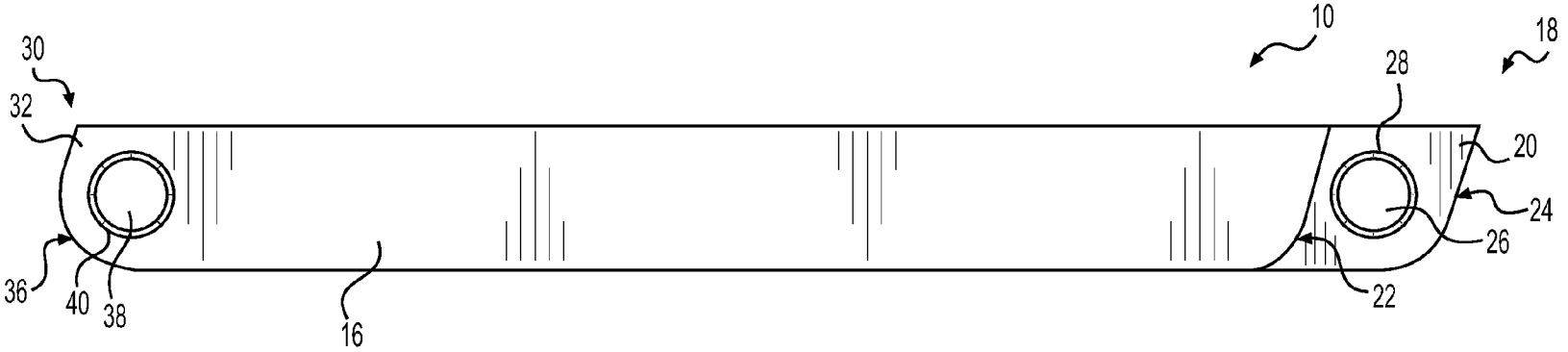
FIG. 2 is a side view of the link of FIG. 1.
Figure 3:
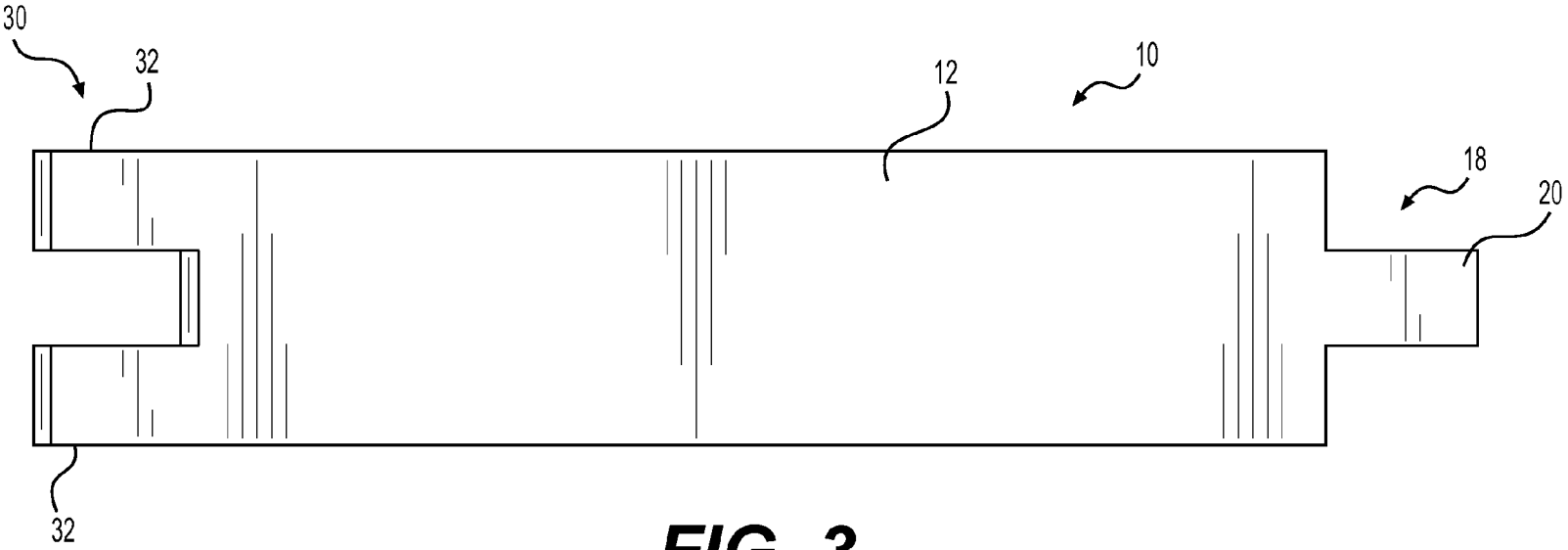
FIG. 3 is a top view of the link of FIG. 1.
Figure 4:
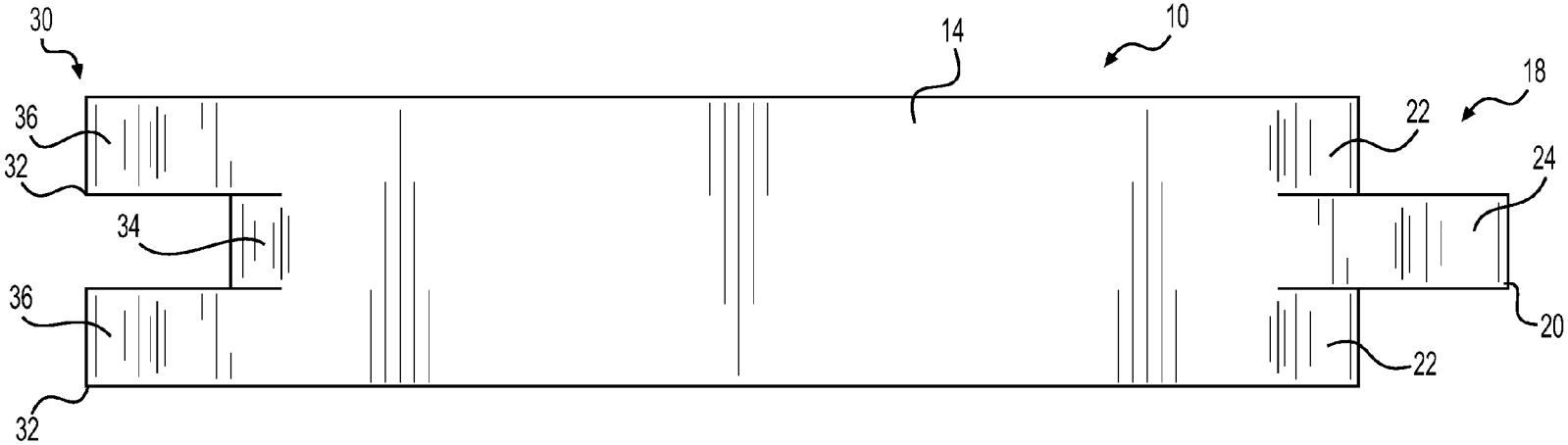
FIG. 4 is a bottom view of the link of FIG. 1.
Figure 6:
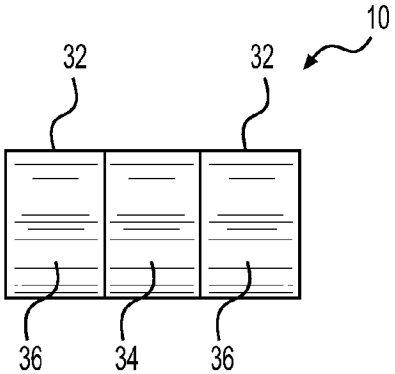
FIG. 6 is a left end view of the link of FIG. 1.
Figure 5:
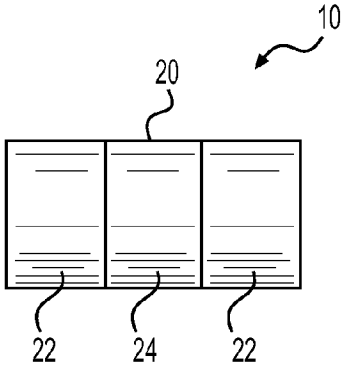
FIG. 5 is a right end view of the link of FIG. 1.
Figure 7:
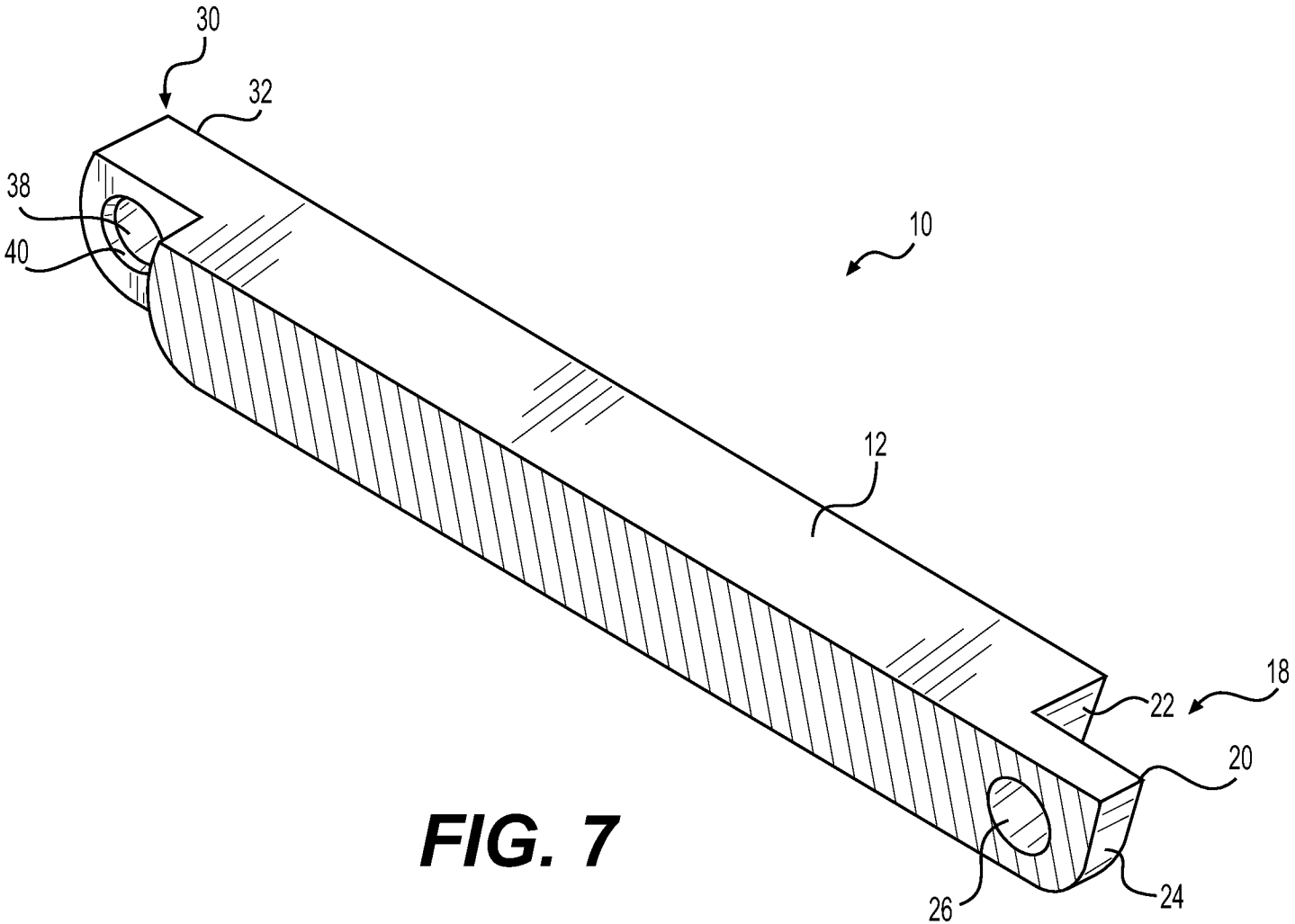
FIG. 7 is a cross-sectional perspective view of the link of FIG. 1, along the line shown in FIG. 1.
Figure 8:
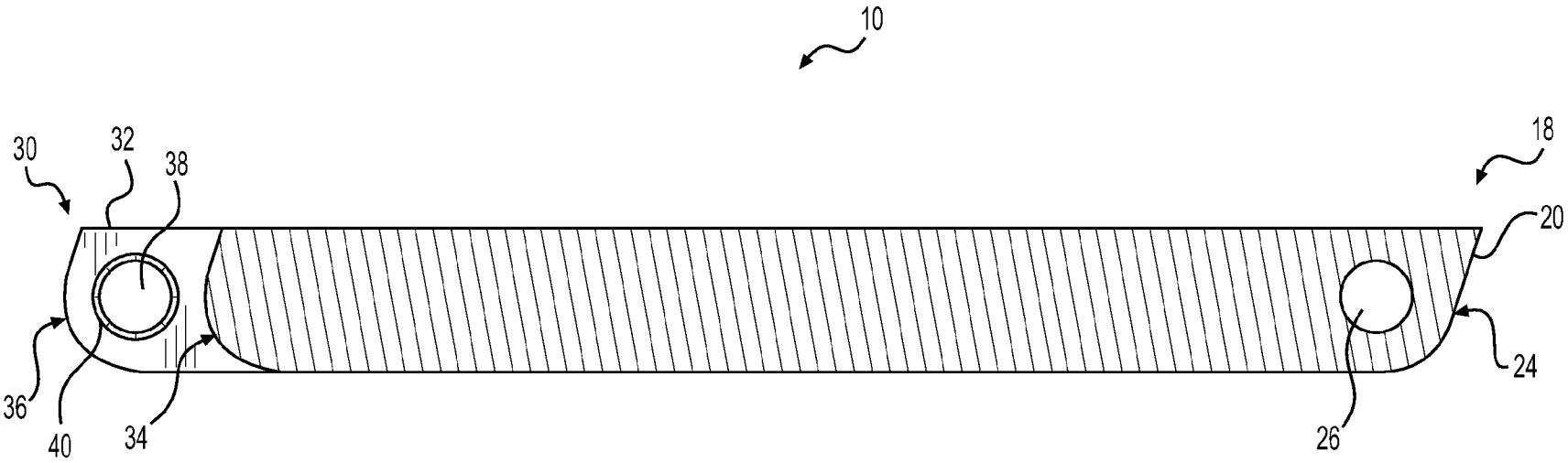
FIG. 8 is a cross-sectional side view of the link of FIG. 1, along the line shown in FIG. 1. A cross-sectional side view from the opposite side would be a mirror-image of FIG. 8.

The single finger 20 of link 10 has a sloped or contoured face 24 (the contour of which is seen in FIGS. 1, 2, 7, and 8). Link 10 further comprises shoulders 22 on opposite sides of the single finger 20. Shoulders 22 also have a slope or contour (the contour is seen in FIGS. 1 and 2) that is the same as the contour of face 24. Similarly, each of the double fingers 32 of link 10 has a sloped or contoured face 36 (the contour of which is seen in FIGS. 1, 2, 7, and 8). Link 10 further comprises shoulder 34 between the double fingers 32. Shoulder 34 also has a slope or contour (the contour is seen in FIGS. 7 and 8) that is the same as the contour of faces 36. As mentioned above, the first and third links (and any other links) are typically identical to link 10 and so have the same shoulders and contours on the corresponding ends as described in relation to link 10.

The contour of the face 24 of the single finger 20 of link 10 cooperates with the contour of the shoulder between the double fingers of the adjoining third link, and the contour of each of the shoulders 22 of link 10 cooperates with the contour of a corresponding double finger of the adjoining third link, such that link 10 and the third link are able to hingedly move in a first direction from the linear arrangement to a bent arrangement but are not able to hingedly move from the linear arrangement to a bent arrangement in a second direction opposite the first direction. Similarly, the contour of the face of the single finger of the adjoining first link cooperates with the contour of the shoulder 34 between the double fingers 32 of link 10, and the contour of each of the shoulders on either side of the single finger of the adjoining first link cooperates with the contour of a corresponding double finger 32 of link 10, such that the first link and link 10 are able to hingedly move in a first direction from the linear arrangement to a bent arrangement but are not able to hingedly move from the linear arrangement to a bent arrangement in a second direction opposite the first direction.

As mentioned above, all other links are typically identical to link 10 and have the same shoulders and contours on the corresponding ends as described in relation to link 10. As such, each hingedly joined pair of adjoining links are able to hingedly move in a first direction from the linear arrangement to a bent arrangement but are not able to hingedly move from the linear arrangement to a bent arrangement in a second direction opposite the first direction. As each pair of adjoining links have this structure, the lifting device as a whole is able to hingedly move in the first direction from the linear arrangement to a bent arrangement but is not able to hingedly move from the linear arrangement to a bent arrangement in the second direction opposite the first direction.

Link 10 and other links of the lifting device of embodiments of the invention are illustrated and described herein as having a single finger on one end and double fingers on the opposite end. Alternative embodiments of the invention may have different numbers of fingers on the ends of the links. For example, in one alternative embodiment of the invention, each link has one finger on each end. In such an embodiment, each finger would typically have a width of about half the width of the overall link. In another alternative embodiment of the invention, each link has two fingers on each end. In another alternative embodiment of the invention, each link has two fingers on one end and three fingers on the opposite end. Any desired number and arrangement of fingers may be used as long as the fingers and shoulders have the necessary cooperating contours to enable the lifting device to hingedly move in a first direction from the linear arrangement to a bent arrangement but is not able to hingedly move from the linear arrangement to a bent arrangement in a second direction opposite the first direction.

Figure 11:
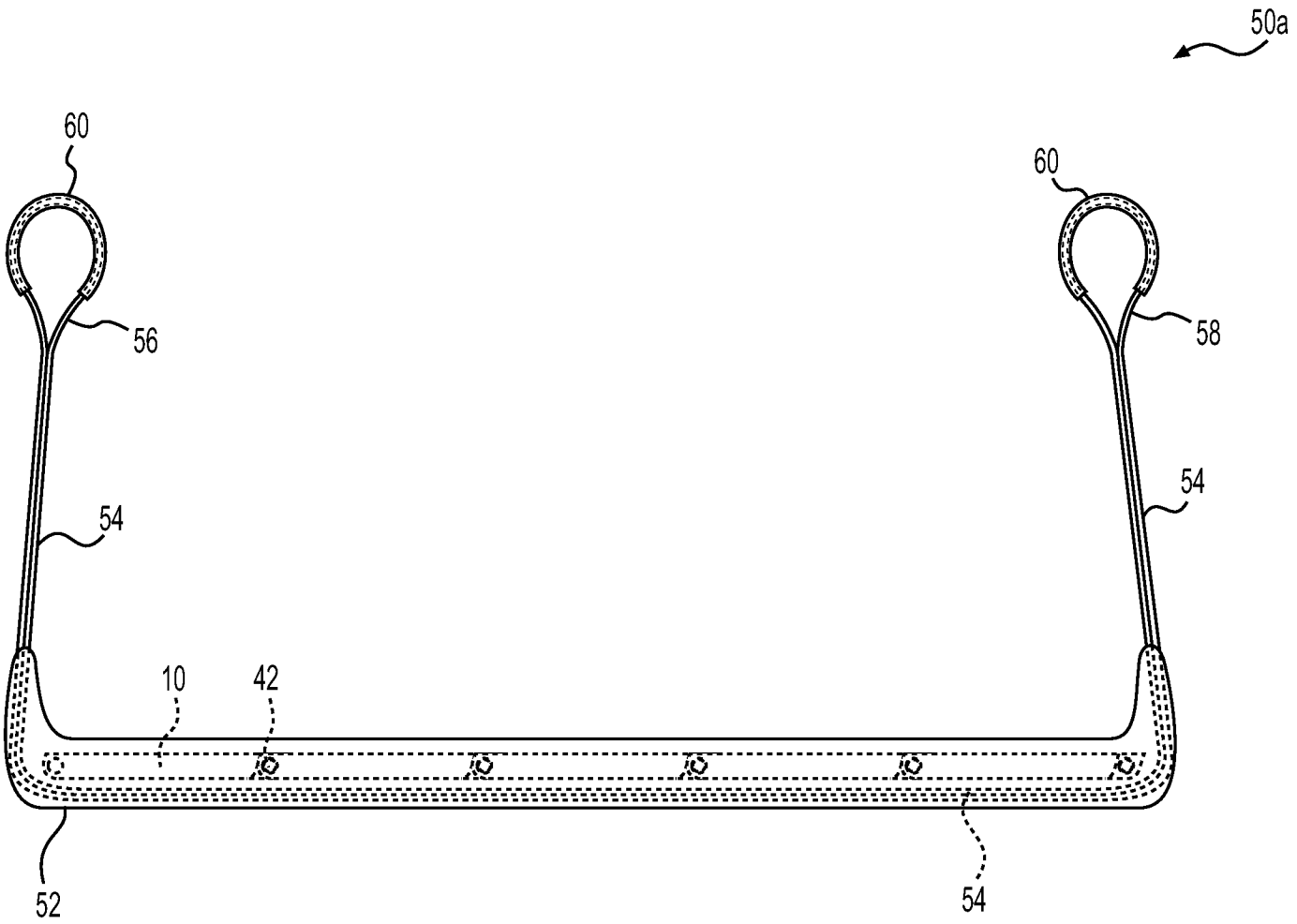
FIG. 11 is side view of a lifting device, in accordance with embodiments of the invention.

Referring now to FIG. 11, a lifting device 50*a* of embodiments of the invention typically further comprises a flexible sleeve 52 at least partially enclosing (and typically fully enclosing) the links. FIG. 11 shows five links 10 within the sleeve 52, the links joined as described above with hinge pins 42. The flexible sleeve 52 is typically constructed of a suitably strong, durable, and abrasion-resistant fabric (natural or synthetic), including but not limited to nylon, Kevlar®, or canvas, or combinations or blends of these and/or other materials. In one embodiment of the invention, the sleeve 52 is constructed of 1000 denier Cordura® nylon (5'×~20") that is doubled for additional abrasion resistance and sewn with a three inch overlap into an elongated sleeve. The sleeve material may have a water repellant coating, such a urethane solvent. The flexible sleeve 52 has a first end and a second end, and each end is typically sewn closed. Sewing the ends closed helps retain the links within the sleeve and helps retain the strap (discussed below) in position relative to the sleeve.

Lifting device 50*a* may further comprise a strap 54 for connecting the sleeve and links to the forks of a forked machine in order to lift a load (described further below). Conceptually, the strap 54 can be thought of as comprising a first strap, a second strap, and a connecting strap therebetween. The first strap has a first end and a second end, with the first end having a loop 56 and the second end being affixed to or protruding from the first end of the flexible sleeve 54. The second strap has a first end and a second end, with the first end having a loop 58 and the second end being affixed to or protruding from the second end of the flexible sleeve. The first strap, the second strap, and the connecting strap could be separate straps that are affixed (e.g., sewn) together. However, the lifting device of embodiments of the invention will typically be constructed such that the first strap, the second strap, and the connecting strap are a single, unitary strap (as such, the strap will be illustrated and described herein as a single, unitary structure). The strap 54 is partially enclosed (typically the center or connecting portion) within the sleeve 52. Some or all of the enclosed portion of the strap 54 may be affixed (e.g., sewn) to an inside surface of the flexible sleeve. In one embodiment of the invention, the strap 54 is constructed of a single 28'6" length of 2" wide nylon strap with a 14,700 pound breaking strength, doubled (seen in FIGS. 11-13) for added strength with the two layers sewn together along the entire length (except at the loops 56, 58), with additional stitching adjacent the loops for added strength. However, any suitable material in any suitable length/width may be used for the strap. In one embodiment of the invention, a reinforcing layer 60 is sewn in place around each loop 56, 58. The reinforcing layer 60 may be constructed using, for example, the same material from which the sleeve 52 is constructed. In one embodiment of the invention, the links may be affixed to the enclosed portion of the strap 54 and/or to the inside of the sleeve 52, such as with double-sided tape or another material/solution that effectively aligns the strap/sleeve with the links.

Figure 12:
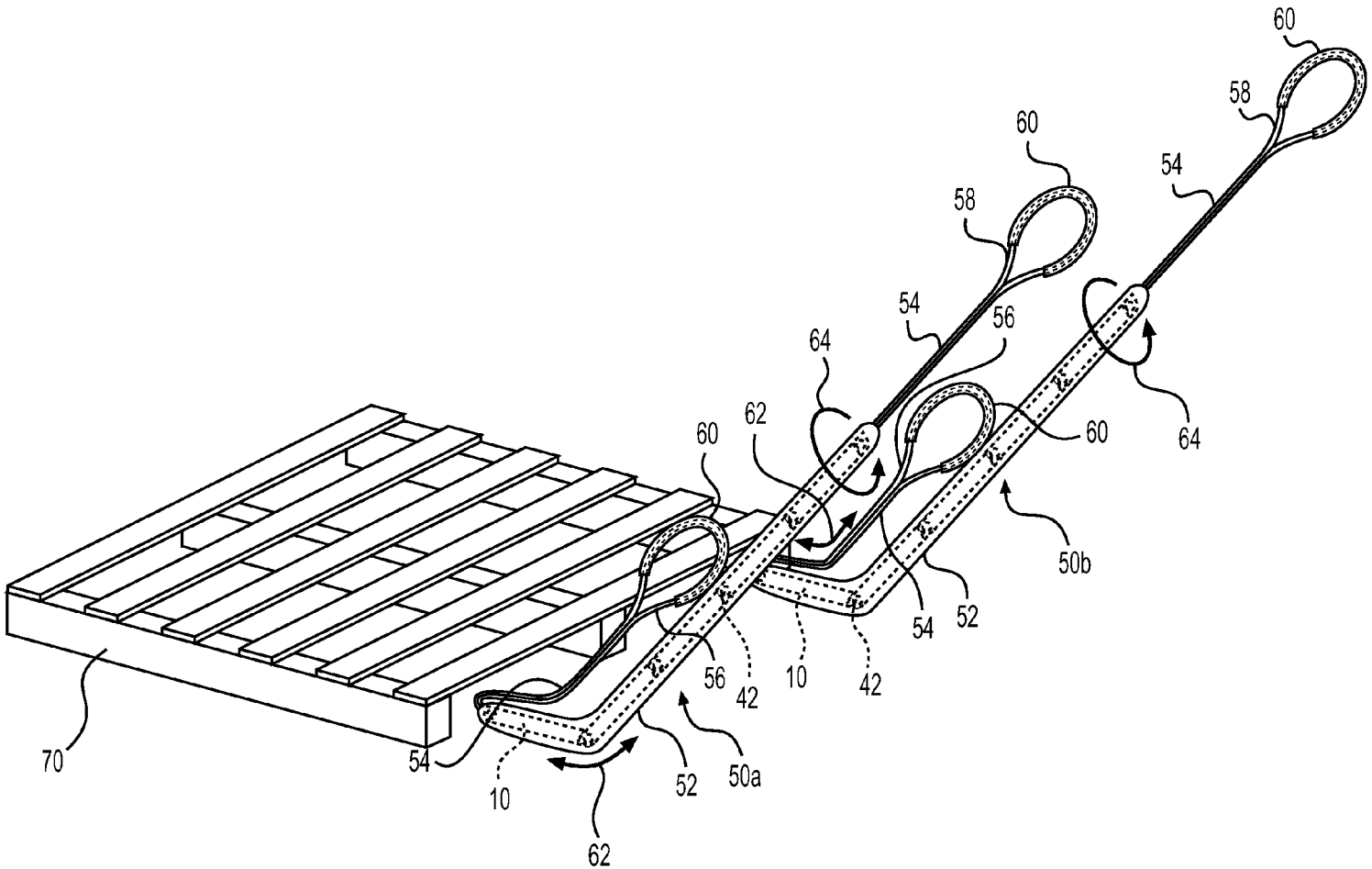
FIG. 12 is a perspective view of the insertion of two lifting devices into the openings between the top and bottom decks of a pallet, in accordance with embodiments of the invention.

While one lifting device 50*a* is illustrated in FIG. 11, a pallet lift system of embodiments of the invention will typically comprise two lifting devices similar or identical to lifting device 50*a* (but a different number of lifting devices could be used). Referring now to FIGS. 12 and 13, a method of lifting a pallet using a pallet lift system of embodiments of the invention is illustrated. The pallet lift system of FIGS. 12 and 13 comprises a first pallet lifting device 50*a* (as illustrated in detail in FIG. 11) and a second pallet lifting device 50*b* (which is identical to the first pallet lifting device 50*a*). While FIGS. 12 and 13 illustrate a pallet 70 without any load, the pallet 70 will typically have a load in place on it when the pallet lift system is used. While not illustrated in FIGS. 12 and 13, the pallet lifting system of embodiments of the invention may be advantageously used to lift a pallet onto or off of a vehicle or trailer with vertical sides or near some other vertical obstructions that makes it difficult or impossible to conventionally lift the pallet with a forked machine because the vertical sides/obstruction impedes horizontal access to the fork pocket openings between the top deck and the bottom deck of the pallet. As illustrated in FIG. 12, the first lifting device 50*a* is oriented such that the device can bend upward (like the orientation illustrated in FIG. 9). This upward bending of the first lifting device 50*a* enables one end of the first lifting device 50*a* (for the purpose of describing FIGS. 12 and 13, this end of the first lifting device 50*a* will be termed the leading end; either end of the lifting device may be used as the leading end) to be inserted downward between the insertion end of the pallet 70 (i.e., the end closest to the first lifting device 50*a* into which the first lifting device 50*a* will be inserted; the insertion end is typically arbitrarily selected, as typically either end of the pallet 70 could serve as the insertion end) (along with any load on the pallet 70) and the vertical side/obstruction. The leading end of the first lifting device 50*a* may then be inserted into one of the fork pockets between the top and bottom decks of the pallet 70, and the first lifting device 50*a* may be pushed through the fork pocket until the leading end of the first lifting device 50*a* protrudes from the other end of the pallet 70 while the trailing end of the first lifting device 50*a* protrudes from the insertion end of the pallet 70. While FIG. 12 only shows a bend at one point in each lifting device, as each lifting device is inserted into the pallet it will typically be necessary (depending on height of the vertical wall/obstruction and the distance between the pallet and the vertical wall/obstruction) for each lifting device to be bent at different points along the device at different times during insertion (or removal).

The correct placement of the first lifting device 50*a* within the pallet 70 for lifting the pallet 70 and its load is illustrated in FIG. 13. Arrow 62 illustrates the insertion (and later removal) of the first lifting device 50*a* into the pallet fork pocket. The strap affixed to the leading end of the first lifting device 50*a* (in FIGS. 12 and 13 that is the strap that includes loop 56) may then be pulled through the space between the top and bottom decks of the pallet 70 until the strap (and especially the loop 56) is freely accessible on the end of the pallet 70 opposite the insertion end.

Once the first lifting device 50*a* is properly inserted and in place between the top and bottom decks of the pallet (at which point the first lifting device 50*a* should be unbent as the first lifting device 50*a* would be resting on the bottom deck of the pallet 70 (or on the floor of the truck/trailer or the ground if the pallet does not have a bottom deck)), the first lifting device 50*a* is rotated 180 degrees about its longitudinal axis (this rotation is illustrated by arrow 64 if FIG. 12) such that the first lifting device 50*a* is oriented as in FIG. 10. This orientation prevents the lifting device from bending as a lifting force is applied to the straps and the pallet is lifted (described below).

The second lifting device 50*b* may then be inserted within the pallet 70 (typically into a second fork pocket between the top and bottom decks of the pallet 70) just as described above in relation to the first lifting device 50*a*.

A forked machine, with its forks 72 at a level higher than the top of the load on the pallet, is advanced toward one of the sides of the pallet 70 that are orthogonal to the sides from which the lifting devices protrude. When the distal ends of the forks 72 have reached the closest lifting device (in FIG. 13 that is the second lifting device 50*b*) (or the forks 72 are close enough to the closest lifting device), each loop 56, 58 of the strap 54 of the closest lifting device is placed onto a corresponding fork 72. The forked machine is further advanced until the distal ends of the forks 72 have reached the furthest lifting device (in FIG. 13 that is the first lifting device 50*a*) (or the forks 72 are close enough to the furthest lifting device), and each loop 56, 58 of the strap 54 of the furthest lifting device is placed onto a corresponding fork 72. As the distal ends of the forks 72 are advanced over the top of the load, the loops 56, 58 of the each lifting device are slid down the forks 72 such that the loops 56, 58 are in generally vertical alignment above the their corresponding lifting device (as seen in FIG. 13) when the pallet is to be lifted.

When all of the loops 56, 58 are in place on the forks 72 as illustrated in FIG. 13, the forks 72 may be raised which in turn applies a lifting force and raises the entire arrangement of lifting system, pallet, and load. The forked machine may then be moved to move the pallet to any desired location/position. For example, the pallet may be moved to a position above a truck bed or trailer to load the pallet onto the truck or trailer.

Once the pallet is in its desired location/position, the forks 72 may be lowered which in turn lowers the entire arrangement of lifting system, pallet, and load. When the pallet is back on the truck/trailer/ground, the forked machine may be backed away from the pallet with the loops 56, 58 being removed from the forks 72 before or as that occurs. Each lifting device 50*a*, 50*b* may then be rotated 180 degrees about its longitudinal axis, which allows the each lifting device to be pulled outward from either end of the pallet and upward between the pallet and any vertical obstruction. (The rotation step may not be necessary (either when placing the lifting devices into the pallet or removing the lifting devices from the pallet) if there is no vertical wall/obstruction near the pallet.

Figure 14:
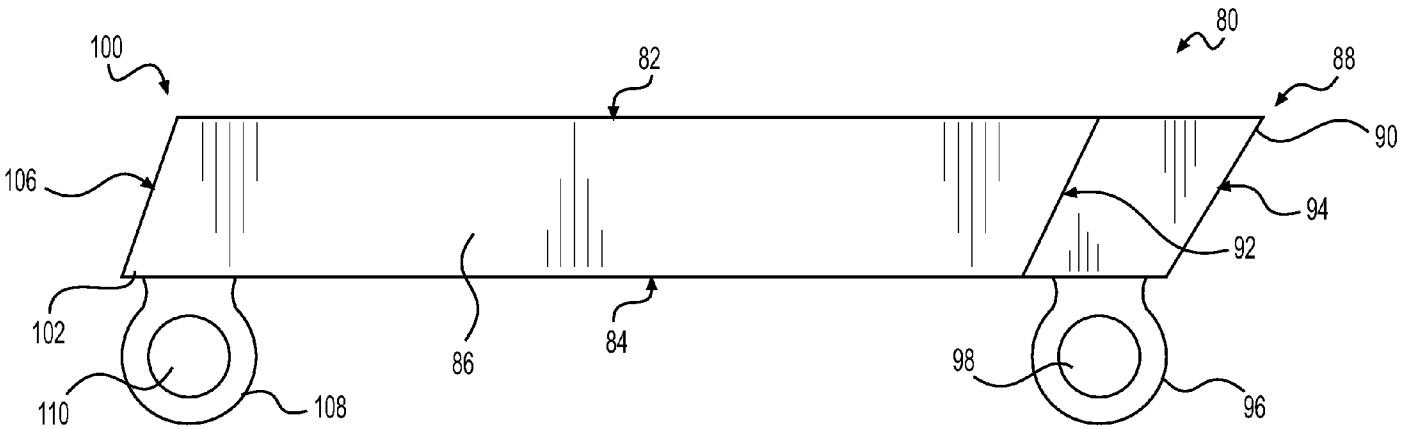
FIG. 14 is a side view of one link of a lifting device, in accordance with alternative embodiments of the invention.
Figure 15:
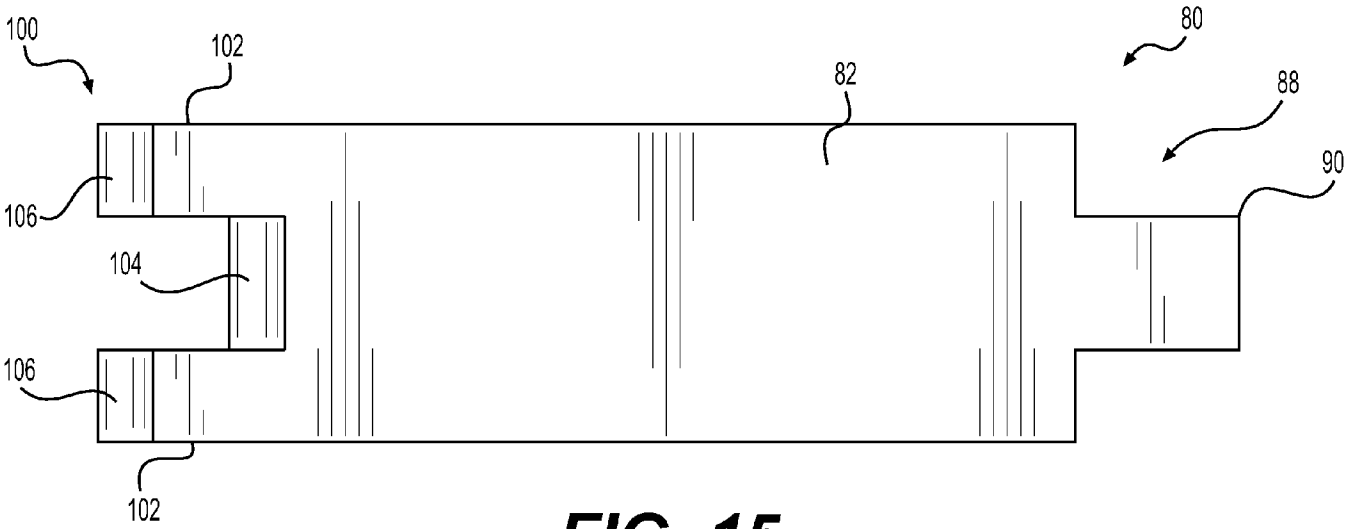
FIG. 15 is a top view of the link of FIG. 14.
Figure 16:
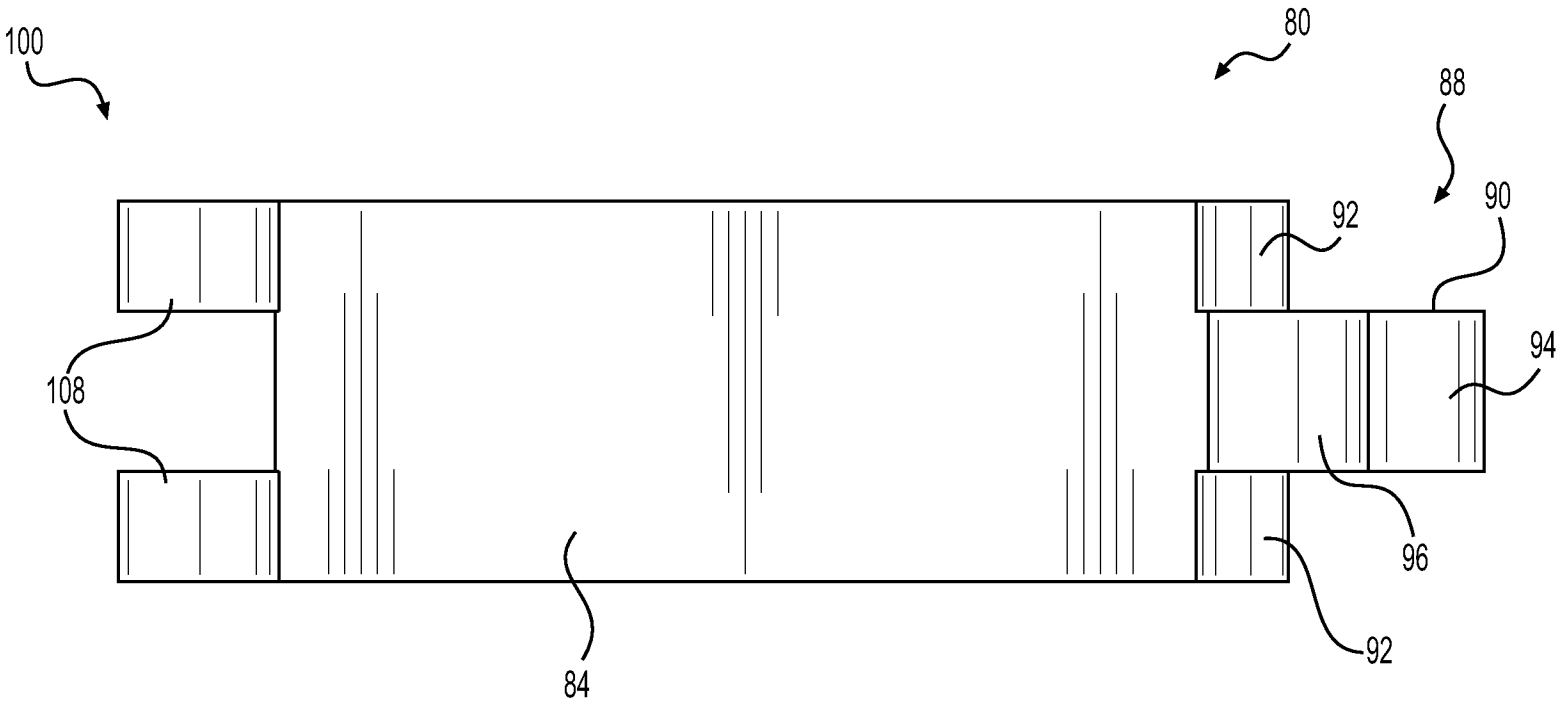
FIG. 16 is a bottom view of the link of FIG. 14.

Referring now to FIGS. 14-16, a link 80 of a lifting device is illustrated in accordance with alternative embodiments of the invention. Link 80 is similar to link 10 in that link 80 is generally elongated, having a first end 88 and a second end 100. The width of the top surface 82 and bottom surface 84 is typically (although not necessarily) greater than the height of the side surface 86. Link 80 comprises a single finger 90 projecting from its first end 88 and double fingers 102 projecting from its second end 100. The single finger 90 of link 80 has a sloped face 94 (however, unlike in link 10, the single finger 90 of link 80 has a flat slope). Link 80 further comprises shoulders 92 on opposite sides of the single finger 90. Shoulders 92 also have a slope (also flat) that is the same as the slope of face 94. Similarly, each of the double fingers 102 of link 80 has a sloped face 106 (also a flat slope). Link 80 further comprises shoulder 104 between the double fingers 32. Shoulder 34 also has a slope (also a flat slope) that is the same as the slope of faces 106.

The slope of the face 94 of the single finger 90 of link 80 cooperates with the contour of the shoulder between the double fingers of an adjoining link, and the contour of each of the shoulders 92 of link 80 cooperates with the contour of a corresponding double finger of the same adjoining link. Similarly, the contour of the face of the single finger of another adjoining link cooperates with the contour of the shoulder 104 between the double fingers 102 of link 80, and the contour of each of the shoulders on either side of the single finger of the same adjoining link cooperates with the contour of a corresponding double finger 102 of link 80. As with link 10, the cooperation between the slopes of the fingers and shoulders of link 80 and similar or identical adjoining links enable the links to hingedly move in a first direction from the linear arrangement to a bent arrangement but are not able to hingedly move from the linear arrangement to a bent arrangement in a second direction opposite the first direction.

Unlike link 10, through-holes are not defined in the fingers of link 80 to enable the links to be hingedly affixed. Rather, link 80 comprises an axle hub 96 downwardly projecting from the single finger 90 and axle hubs 108 downwardly projecting from each of the double fingers 102. A through-hole 98 is defined in axle hub 96 and a through-hole 110 is defined in each of axle hubs 108.

To hingedly join link 80 with the adjoining links, the single finger 90 of link 80 is inserted between the double fingers of a similar or identical adjoining link (having similar or identical axle hubs and through-holes as link 80) such that the through-holes of the three axle hubs are aligned. A hinge pin (not illustrated) is then inserted through all three of the aligned through-holes. Similarly, the single finger of a different adjoining link is inserted between the double fingers 102 of link 80 such that the through-holes of the three axle hubs are aligned. A hinge pin (not illustrated) 42 is then inserted through all three of the aligned through-holes. Such hingedly joined links comprising link 80 and other similar or identical adjoining links functions the same (in that it is uni-directional) as the hingedly joined links comprising link 10 described above.

The lifting devices, systems, and methods of embodiments of the invention provide many advantages over conventional devices. The lifting devices and systems of embodiments of the invention are lightweight relative to their load-bearing capacity and are easy to deploy and retract, especially in confined spaces. The lifting devices and systems of embodiments of the invention require a small space to store and transport, since the devices can be "rolled" up. The lifting devices and systems of embodiments of the invention can be used with virtually any forked machine and with virtually any type of pallet.

Embodiments of the invention are described herein as a lifting device, system, and method, and specifically a pallet lifting device, system, and method. However, link systems of embodiments of the invention may be used for drive systems or conveyor systems. Such link systems may comprise a plurality of links (such as link 10 or link 80) that are hingedly joined in a continuous loop. That is, every link is hingedly joined (in the manner described above) to two other links such that a continuous loop of links is formed.

Conventional link systems are used as chains such as for drive systems or conveyor systems. In larger formats, conventional link systems can relate to rail cars. Conventional chain link systems are designed to be driven by a drive sprocket (possibly with vibration dampening features). The conventional conveyor chain link system has several parts that must be joined to create a load bearing surface for conveying a load along the length of the conveyor. The conventional conveyor chain link system is then combined with other frame and material handling components to form a conveyor. In the case of larger scale conventional link systems, the links are supported by a track and are only intended to be used in a one-way, right-side-up configuration, and the links must flex on both axes to be effective.

Advantageously, a continuous loop of links of embodiments of the invention may be supported and moved along a pre-defined path by sprockets, pulleys, and/or the like. The bending or articulation in one direction allows for routing the loop around drive or support sprockets or the like, while the inability to bend or articulate in the opposite direction enables a load to be supported on the top, load-bearing surface of the loop. Such a continuous loop of links of embodiments of the invention provides support and conveying capability with greater load-bearing capacity using far fewer components than conventional conveyor systems. Additionally, deployment and operation of such a continuous loop of links of embodiments of the invention is possible is spaces just slightly wider than each link. Such a link system of embodiments of the invention can be combined with additional support structure to extend the operational length of the load bearing portion of the loop.

Whether used as a lifting system, a conveyor system, or in some other capacity, embodiments of the invention provide a device, system, and method for supporting loads over a span.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The embodiment was chosen and described in order to best explain the principles of the invention and the practical application, and to enable others of ordinary skill in the art to understand the invention for various embodiments with various modifications as are suited to the particular use contemplated.

That which is claimed:

1. A lifting device comprising:

three or more links hingedly joined end-to-end such that the lifting device is able to hingedly move in a first direction from a linear arrangement to a bent arrangement but is not able to hingedly move from the linear arrangement to a bent arrangement in a second direction opposite the first direction;

a flexible sleeve at least partially enclosing the three or more links;

wherein the three or more links comprise a first link, a second link, and a third link;

wherein each link comprises a first end and a second end such that the first end of the second link is hingedly joined to the second end of the first link and such that the second end of the second link is hingedly joined to the first end of the third link;

wherein the first link comprises a single finger projecting from its second end; wherein the second link comprises two fingers projecting from its first end;

wherein through-holes are defined in each of the single finger of the first link and the double fingers of the second link;

wherein the first link and the second link are aligned such that the through-holes of the single finger and the double fingers are aligned;

wherein a hinge pin is at least partially inserted through each of the through-holes of the single finger and the double fingers;

wherein the second end of the first link comprises a first shoulder on one side of the single finger and a second shoulder on an opposite side of the single finger;

wherein the first end of the second link comprises a shoulder between the double fingers; and wherein (1) a contour of a distal end of the single finger cooperates with a contour of the shoulder between the double fingers and (2) a contour of a distal end of each of the double fingers cooperates with a contour of a corresponding one of the first and second shoulders on opposite sides of the first finger such that the lifting device is able to hingedly move in the first direction from the linear arrangement to a bent arrangement but is not able to hingedly move from the linear arrangement to a bent arrangement in the second direction opposite the first direction.

2. The device of claim 1, wherein the second link comprises a single finger projecting from its second end;

wherein the third link comprises two fingers projecting from its first end;

wherein through-holes are defined in each of the single finger of the second link and the double fingers of the third link;

wherein the second link and the third link are aligned such that the through-holes of the single finger of the second link and the double fingers of the third link are aligned; and wherein a hinge pin is at least partially inserted through each of the through-holes of the single finger of the second link and the double fingers of the third link.

3. The device of claim 1, wherein the first link comprises at least one finger projecting from its second end;

wherein the second link comprises at least one finger projecting from its first end;

wherein through-holes are defined in each of the at least one finger of the first link and the at least one finger of the second link;

wherein the first link and the second link are aligned such that the through-holes of the at least one finger of the first link and the at least one finger of the second link are aligned; and wherein a hinge pin is at least partially inserted through each of the through-hole of the at least one finger of the first link and the through-hole of the at least one finger of the second link.

4. The device of claim 3, wherein (1) a contour of a distal end of the at least one finger of the first link cooperates with a contour of a shoulder adjacent the at least one finger of the second link and (2) a contour of a distal end of the at least one finger of the second link cooperates with a contour of a shoulder adjacent the at least one finger of the first link such that the lifting device is able to hingedly move in the first direction from the linear arrangement to a bent arrangement but is not able to hingedly move from the linear arrangement to a bent arrangement in the second direction opposite the first direction.

5. The device of claim 3, wherein the second link comprises at least one finger projecting from its second end;

wherein the third link comprises at least one finger projecting from its first end;

wherein through-holes are defined in each of the at least one finger of the second end of the second link and the at least one finger of the first end of the third link;

wherein the first link and the second link are aligned such that the through-holes of the at least one finger of the second end of the second link and the at least one finger of the first end of the third link are aligned; and wherein a hinge pin is at least partially inserted through each of the through-hole of the at least one finger of the second end of the second link and the at least one finger of the first end of the third link.

6. The device of claim 1, wherein the flexible sleeve fully encloses the three or more links.

7. The device of claim 1, wherein the flexible sleeve is constructed of fabric.

8. The device of claim 7, wherein the fabric comprises nylon.

9. The device of claim 1, further comprising:

a first strap having a first end and a second end, the second end being affixed to or protruding from a first end of the flexible sleeve; and a second strap having a first end and a second end, the second end being affixed to or protruding from a second end of the flexible sleeve.

10. The device of claim 9, wherein the first strap comprises a loop at its first end and wherein the second strap comprises a loop at its first end.

11. The device of claim 9, further comprising a connecting strap affixed to or contiguous with the second end of the first strap and the second end of the second strap.

12. The device of claim 11, wherein the connecting strap is at least partially enclosed within the sleeve.

13. The device of claim 11, wherein the connecting strap is fully enclosed within the sleeve.

14. The device of claim 11, wherein the first strap, the second strap, and the connecting strap together comprise a unitary structure.

15. The device of claim 11, wherein the connecting strap is at least partially affixed to an inside surface of the flexible sleeve.

16. The device of claim 11, wherein one or more of the links is affixed to an inside surface of the flexible sleeve and/or to the connecting strap.

* * * * *